United States Patent [19]

Kitzman

[11] Patent Number: 4,502,229

[45] Date of Patent: Mar. 5, 1985

[54] GRAIN DRYER

[76] Inventor: H. Charles Kitzman, R.F.D., Conrad, Iowa 50261

[21] Appl. No.: 498,712

[22] Filed: May 27, 1983

[51] Int. Cl.[3] ..... F26B 17/12

[52] U.S. Cl. ..... 34/56; 34/65; 34/167; 34/168; 34/170; 34/175; 432/102

[58] Field of Search ..... 34/65, 56, 170, 168, 34/167, 175; 432/99, 100, 102

[56] References Cited

U.S. PATENT DOCUMENTS

| | | | |
|---|---|---|---|
| 2,036,127 | 3/1936 | Edholm | 34/34 |
| 2,183,274 | 12/1939 | Barnsdale | 34/34 |
| 2,701,920 | 2/1955 | Campbell | 34/65 |
| 3,097,934 | 7/1963 | Applegate | 34/56 |
| 3,300,873 | 1/1967 | Bussell et al. | 34/168 |
| 3,373,503 | 3/1968 | Kline et al. | 34/33 |
| 3,404,467 | 10/1968 | Burghard | 34/56 |
| 3,636,638 | 1/1972 | Noyes | 34/56 |
| 3,727,323 | 4/1973 | Meiners | 34/170 |
| 3,913,242 | 10/1975 | Fackler et al. | 34/170 |
| 3,931,683 | 1/1976 | Crites et al. | 34/169 |
| 4,006,536 | 2/1977 | Meiners | 34/169 |
| 4,020,561 | 5/1977 | Mathews | 34/65 |
| 4,067,120 | 1/1979 | Bradford | 34/65 |
| 4,165,216 | 8/1979 | White et al. | 432/102 |
| 4,236,321 | 12/1980 | Palmonari et al. | 34/57 E |

OTHER PUBLICATIONS

Advertising Brochure of Vertec Farm Equipment, Inc., entitled Vertec.

*Primary Examiner*—Larry I. Schwartz
*Assistant Examiner*—David W. Westphal
*Attorney, Agent, or Firm*—Zarley, McKee, Thomte, Voorhees & Sease

[57] ABSTRACT

The grain dryer of the present invention includes a housing having two spaced apart vertical partitions therein which divide the housing into a central compartment, a front compartment and a rear compartment. Air intake openings are provided in the two vertical partitions so as to provide communication from the central compartment to the two front and rear compartments through the two partitions. The front and rear walls of the housing are also provided with exhaust openings which permit air to exit from the front and rear compartments outwardly through the front and rear walls respectively. A first group of ventilator members are located within the front and rear compartments and are connected to the inlet openings within the partitions for guiding air into the front and rear compartments from the central compartments. A second group of ventilator members are connected to the exhaust openings in the front and rear walls of the housing and are adapted to channel the air from the front and rear compartments outwardly through the front and rear walls of the housing. At least one heating fan is in communication with the central compartment for forcing hot air into the central compartment adjacent the upper portion of the central compartment. A cooling fan is also in communication with the central compartment for forcing cool air into the lower end of the central compartment. A feeding auger is positioned above the front and rear compartments that includes a conveyor housing mounted thereover.

11 Claims, 6 Drawing Figures

GRAIN DRYER

BACKGROUND OF THE INVENTION

This invention relates to grain dryers and particularly grain dryers which are utilized for drying grain for use as seed.

When grains are harvested for use as seed for the following year, they are usually harvested at a moisture level of approximately 17%. However, these grains cannot be stored with the moisture level this high. Accordingly, it is necessary to dry these grains and bring down their moisture level to approximately 12½% in order to permit the grain to be stored over the winter.

One type of grain dryer which has been utilized for this purpose is a continuous feed grain dryer having three vertically oriented compartments. The two outside compartments have open upper ends for receiving the grain. Within the two outside compartments are a plurality of ventilator tubes which are in communication with the central compartment within the dryer. Air is forced into the central compartment and out through the ventilator tubes into the two outside compartments. The air circulates through the grain and is picked up by a second set of ventilator tubes which carry the air outwardly through the outside walls of the grain dryer to the atmosphere. The grain works its way from the top of the grain dryer to the bottom. When the grain reaches the bottom its moisture level has been reduced to the desired level, and the grain is carried away. Grain is continuously fed through the top and is removed through the bottom of the grain dryer.

Several deficiencies have been encountered with presently known grain dryers such as the one described above. One deficiency is that there is not sufficient air moved through the grain to permit it to be dried adequately in a short period of time. The result is that the grain must move much more slowly through the grain dryer, thereby limiting the capacity of the grain dryer to accommodate grain as it is harvested.

Another deficiency of the above type of grain dryer is that the grain is not properly cooled prior to the time that it exits from the grain dryer. The air that is circulated through the grain during the drying process is usually heated, resulting in the grain being hot as it reaches the bottom of the grain dryer. However, the temperature of the grain must be reduced before it can be stored.

Another deficiency of the presently known grain dryers is the difficulty in providing an automatic system for feeding the grain to the dryer continuously without causing an overflow or a slack in the flow of grain.

Another deficiency of present grain dryers is the fact that only one air temperature is utilized as the grain progresses through the dryer. It would be desirable to have different temperatures at different levels, with the highest temperature being at the top and with the lowest temperature approximating the ambient air temperature at the bottom.

Therefore, a primary object of the present invention is the provision of an improved grain dryer.

A further object of the present invention is the provision of a grain dryer which introduces a high temperature air to the grain at the upper level of the dryer and which introduces air within approximately 10° of the outside ambient temperature at the lower portion of the grain dryer.

A further object of the present invention is the provision of a grain dryer which will accommodate soybeans, corn, wheat, oats, and other types of grain without difficulty.

A further object of the present invention is the provision of a grain dryer which has a feed system utilizing an auger which is enclosed within a housing and which is positioned above the grain dryer.

A further object of the present invention is the provision of a grain dryer having a feed system which automatically turns on when the grain dryer is not full and which automatically turns off when the grain dryer is full.

A further object of the present invention is the provision of a grain dryer which improves the thoroughness with which the drying air is mixed with the grain.

A further object of the present invention is the provision of a grain dryer which can be constructed in a modular form which permits the adding on of additional length, height and volume to the grain dryer without detracting from the ability of the dryer to function efficiently.

A further object of the present invention is the provision of a device which is economical to manufacture, durable in use and efficient in operation.

SUMMARY OF THE INVENTION

The present invention utilizes a grain dryer which has two or more fans mounted in vertical orientation with respect to one another and mounted in communication with the interior of the central compartment of the grain dryer. The uppermost fans are heating fans and include a burner adapted to heat the air exiting from the fan prior to the time that the air is forced into the central compartment. The lower fans heat the air to a progressively lower temperature, and the lowermost fan does not heat the air at all, but forces in air which is within 10° of the outside temperature. Thus, the grain is exposed to the highest temperature (approximately 240° F.) at the time that it is initially introduced to the upper end of the grain dryer. As the grain works it way progressively downward, it is exposed to a lower and lower temperature, until at the bottom of the grain dryer, the grain is exposed to air which is approximately the same as the ambient temperature outside the grain dryer. Thus, when the grain exits from the bottom of the grain dryer, it is cooled off to ambient air temperature and is ready for storage.

The grain dryer of the present invention also utilizes a feed system which comprises an auger extending along the length of the upper portion of the grain dryer. The auger is enclosed within a housing, and grain is fed into one end of the housing adjacent one end of the auger. The auger housing is open on its lower side along the length thereof, so that as the auger conveys the grain along the length of the housing, grain is permitted to fall downwardly into the grain dryer. A sensing switch senses when the grain dryer is full and shuts off the auger so as to prevent overflow. When the grain level is lowered in the grain dryer, the sensing switch again senses this drop in grain level and restarts the auger to fill up the grain dryer again. Thus, the sensing switch constantly maintains the grain dryer in a full condition so that a continuous feed of grain is introduced to the grain dryer.

The upper fans of the grain dryer include burners which are of the internal combustion type. Air is forced through the burner and is heated as it passes through a circular ring of flame. The use of this type of burner produces the greatest efficiency of heat for the amount of fuel that is utilized.

A conveyor is also mounted at the lower end of the grain dryer for carrying away the grain that has been dried. This conveyor utilizes conveyor augers, and the speed of these augers is selectively variable so as to control the rate at which grain passes through the auger.

One problem encountered with grain dryers is that there is poor ventilation adjadent the opposite ends of the grain dryer. The present invention overcomes this problem by placing ventilator members in abutment with the end walls of the grain dryer so that air is directed along the end walls of the grain dryer. This assures complete drying of all of the grain which passes through the grain dryer, including the grain which passes downwardly adjacent the end walls of the grain dryer.

DETAILED DESCRIPTION OF THE PREFERRED EMBODIMENT

Figure 1:
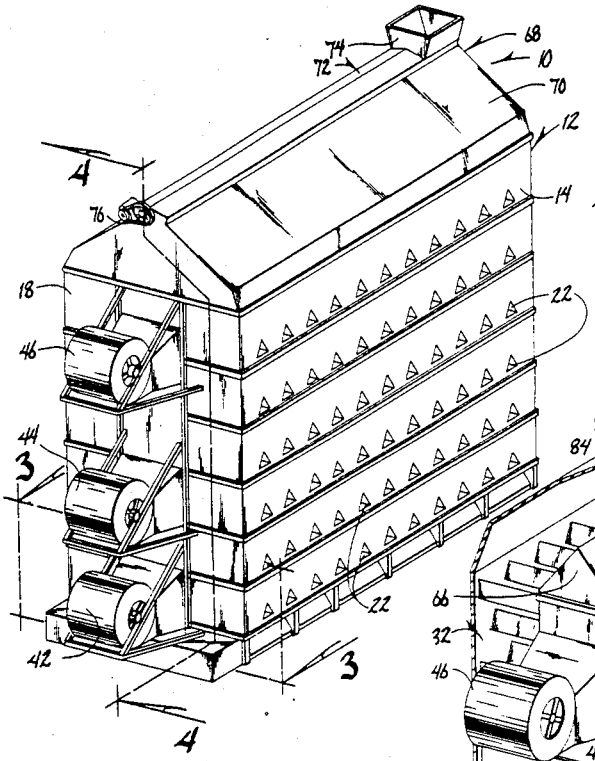
FIG. 1 is a perspective view of the grain dryer of the present invention.

Refering to the drawings, the numeral 10 generally designates the grain dryer of the present invention. Dryer 10 includes an outer housing 12 having a front wall 14, a rear wall 16, an end wall 18 and an opposite end wall 20. Front and rear walls 14, 16 are each provided with a plurality of rows of exhaust openings 22 which are triangular in shape.

Figure 5:
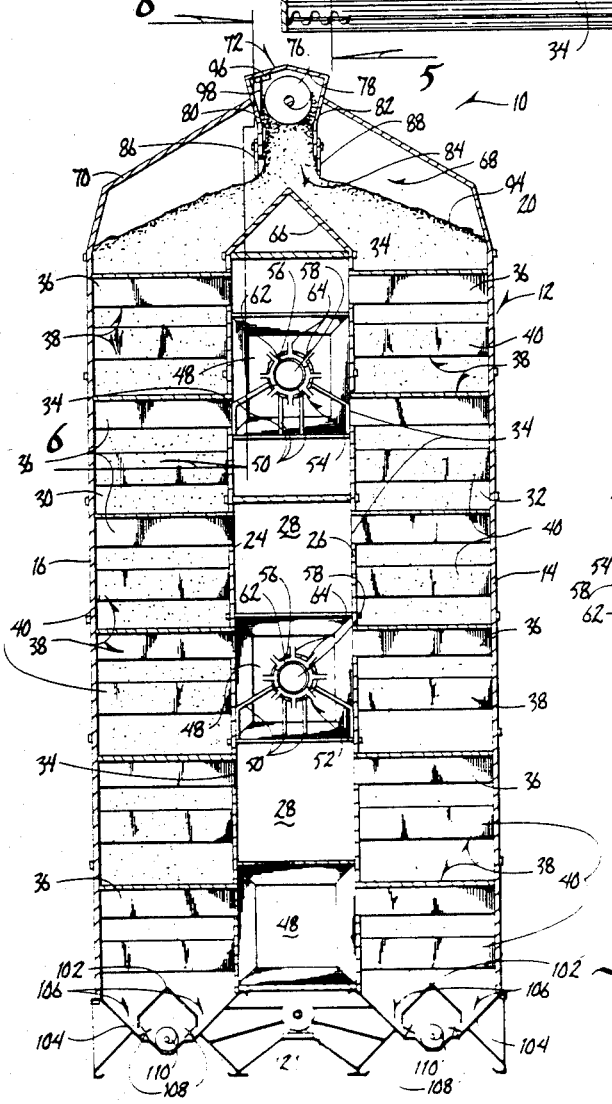
FIG. 5 is a sectional view taken along line 5—5 of FIG. 4.

Within housing 12 are a pair of spaced apart vertical partitions 24, 26 (FIG. 5). Partitions 24, 26 divide the interior of housing 12 into a central compartment 28, a front compartment 30 and a rear compartment 32. Front and rear compartments 30, 32 are adapted to receive the grain to be dried and central compartment 28 is adapted to perform as a manifold for the air which is forced into the grain.

Partitions 24, 26 are each provided with a plurality of triangular shaped openings 34 which provide communication from central compartment 28 into the front and rear compartments 30, 32. Mounted in registered alignment with and connected to triangular openings 34 are a first group of ventilator members 36, each of which is comprised of a triangular shaped angle member having two V-shaped upper legs 38 and an open bottom which permits air to escape downwardly from the ventilator member. The V-shaped legs 38 shield the air from the grain so that the air can pass the length of each ventilator member 36 while at the same time being free to pass downwardly into the grain.

A second group of ventilator members 40 is of the same shape and construction as the first group of ventilator members 36, but differs from ventilator members 36 in that its outer end is in registered alignment with and connected to the triangular exhaust openings 22 in front and rear walls 14, 16. Ventilator members 36 are closed at their outer ends and ventilator members 40 are closed at their inner ends. Thus, the ventilator members 36, 40 permit air to circulate from the central compartment 28 through triangular openings 34 to the space beneath ventilator members 36. The air then passes through the grain, drying the grain, until it reaches the space beneath triangular ventilator members 40, where it is free to pass outwardly through triangular openings 22 in front and rear walls 14, 16.

Figure 6:
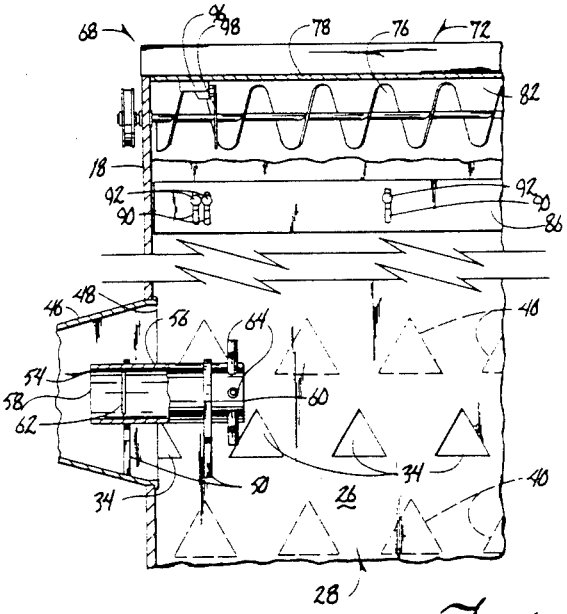
FIG. 6 is a sectional view taken along line 6—6 of FIG. 5.

Mounted on the end of grain dryer 10 are three vertically spaced fans 42, 44, 46. Each of these three fans is in communication with the interior of central compartment 28 through a fan inlet opening 48 as shown in FIG. 6. The two upper fans 44, 46 are each provided with a heater 52, 54, respectively, which is suspended within opening 48 by means of a pair of brackets 50. The lowermost fan 42 does not include any burner, and is adapted to introduce air at ambient temperatures into the lowermost portion of central compartment 28. Heaters 52, 54 are identical in construction, and therefore the structure of only heater 54 is shown in FIG. 6. Heater 54 includes a cylindrical sleeve 56 having an open first end 58 and a closed second end 60. The open end 58 is presented towards fan 46 so as to receive air therefrom. Within sleeve 56 is a circular burner 62. Circular burner 62 is in communication with a fuel, preferably alcohol. However, other types of fuels such as propane or methane could be used. The means for igniting burner 62 and for providing fuel to burner 62 are conventional and are therefore not shown. However, burner 62 is adapted to be ignited so as to provide a circular ring of fire within sleeve 56. As the fuel exiting from burner 62 is ignited, it provides flame within the inside of sleeve 56. Adjacent end 60 of sleeve 56 are a plurality of flame jets 64 which permit the flames to exit and which extend outwardly in a radial direction so as to provide a circular ring of fire around the closed end 60 of the heater. Thus, the air coming from fan 46 provides two functions: first, it provides fresh air and oxygen to the interior of sleeve 56 so as to support combustion; secondly, it forces air around the outside of the sleeve 56 and jets 64 so as to heat the air prior to the time that it enters central chamber 28.

The burner 54 at the upper end of the grain dryer is adapted to heat the air to approximately 240° F. The burner 52 in the central portion of the grain dryer is adapted to heat the air to approximately 200° F. The fan 42 introduces air which is at ambient temperatures to the bottom of the grain dryer so that three different temperatured layers of air are introduced into central compartment 28. The air at the upper portion of compartment 28 is at approximately 240° F.; the air in the central portion of chamber 28 is at approximately 200°, and the air at the bottom of the central chamber 28 is approximately the ambient temperature of the air outside the grain dryer.

The upper end of central compartment 28 is covered with a V-shaped wall or shield 66. The V-shaped arrangement is provided so that grain falling on wall 66 will be deflected laterally so as to fall into the open upper ends of front and rear compartments 30, 32.

Grain is introduced to front and rear chambers 30, 32 by means of a feed system 68. Feed system 68 includes a top wall 70, which has at its center an auger housing 72. At one end of auger housing 72 is a feed hopper 74, into which grain may be introduced. Within auger housing 72 is an elongated feed auger 76. Auger 76 is rotatable within auger housing 72 and extends the length of the grain dryer between the opposite end walls 18, 20. Auger 76 is spaced upwardly above the V-shaped cover 66 and also above the open upper ends of front and rear compartments 30, 32.

Figure 2:
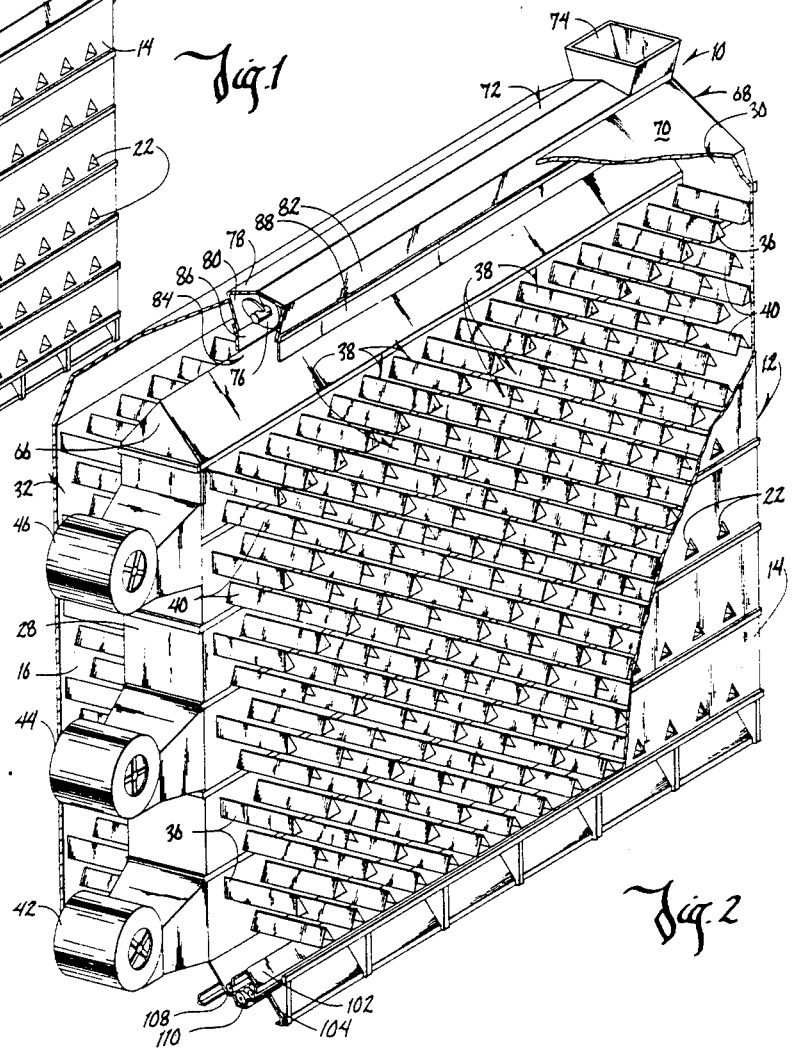
FIG. 2 is an enlarged perspective view showing portions of the outer walls broken away.

Auger housing 72 includes a top wall 78 and two downwardly extending side walls 80, 82. The bottom portion of housing 78 is open as is indicated by the numeral 84 (FIG. 2). Mounted to the lower edges of side walls 80, 82 are a pair of adjustable extension plates 86, 88. Plates 86, 88 are vertically adjustable by means of slots 90 (FIG. 6) and bolts 92 which threadably extend into side walls 80, 82. As can be seen in FIG. 5, the grain which drops downwardly from auger housing 72 strikes V-shaped wall 66 and is deflected laterally so that it falls downwardly through the open upper ends of front and rear chambers 30, 32. The ability to raise and lower plates 86, 88 permits adjustment of the width to which the pile (designated by the numeral 94 in the drawing) of grain spreads laterally. The higher the plates 86, 88 are raised, the wider the spread of the pile 94, and correspondingly, the lower the plates 86, 88 are positioned, the narrower the pile is spread. This permits control of the upper surface of the grain so as to minimize congestion within the grain dryer and prevent clogging, etc.

Figure 4:
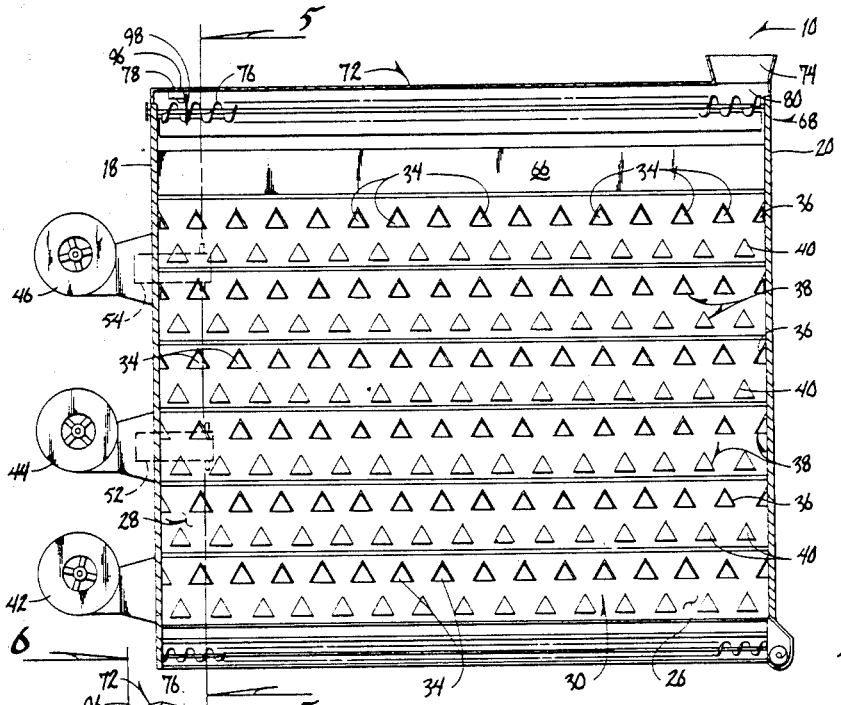
FIG. 4 is a sectional view taken along line 4—4 of FIG. 1.

Referring to FIG. 6, the end of auger 76 which is farthest away from hopper 74, is provided with a sensing switch 96, which has a sensing lever 98 extending downwardly therefrom. Switch 96 is adapted to actuate or deactuate the motor which drives auger 76. As grain is carried across the length of the grain dryer 10 by auger 76, it piles up, commencing with the highest portion of the pile adjacent hopper 74. The dryer fills from the right hand side as viewed in FIG. 4 towards the left hand side. When the left hand side has become full, the grain engages the sensing lever 98, thereby causing switch 96 to move to its off position and deactuate the auger 76. Thus, when the grain dryer is full, auger 76 stops.

When the grain level drops within the grain dryer, switch 98 again, being spring loaded, moves to its closed or on position so as to reactuate the auger and permit the introduction of additional grain into the grain dryer.

At the lower end of grain dryer 10 is a conveyor system for conveying the grain away from the grain dryer after the grain has been dried. The lower ends of front and rear compartments 30, 32 are open, and positioned within these opened lower ends are a pair of inverted V-shaped baffles 102. Positioned below baffles 102 are a pair of substantially V-shaped bottom walls 104. The lower edges of baffles 102 are spaced slightly upwardly from the upwardly diverging walls of bottom walls 104 so as to create two small inlet openings 106 therebetween. Positioned within inlet openings 106 are a pair of metering wheels 108, and positioned between the metering wheels 108 are a pair of auger conveyors 110.

Figure 3:
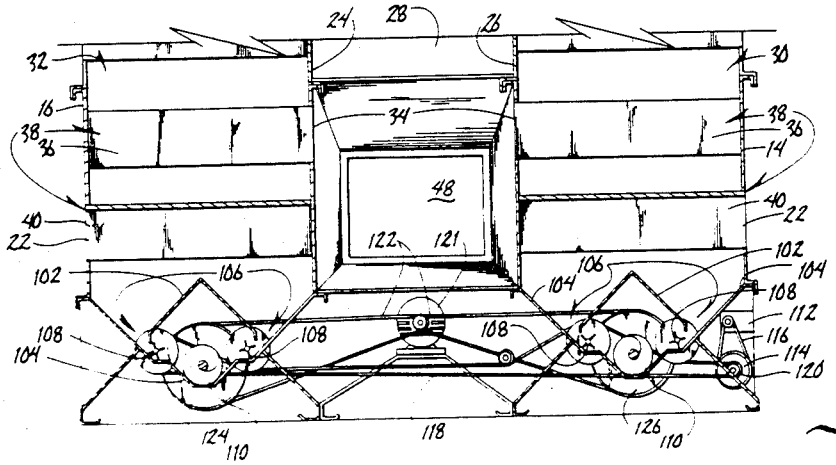
FIG. 3 is a sectional view taken along line 3—3 of FIG. 1.

Referring to FIG. 3, the augers and metering wheels are driven by a belt and pulley system which includes a drive motor 112, which drives a pulley 114 by virtue of a drive belt 116. A second belt 118 is trained around a pulley 120 which is attached to pulley 114, and is also trained around metering wheels 108 so as to rotate them at a predetermined speed.

Augers 110 are driven by a second motor 121 which drives a belt 122 trained around pulleys 124, 126 which are connected to augers 110. Variable speed control means (not shown), are provided for adjusting the speed at which metering wheels 108 and augers 110 operate. Motors 104 and 120 are variable speed motors and control means (not shown) can be used to control the speed at which they operate.

The grain dryer described above provides several advantages over prior devices. The use of three separate fans, each having three different temperatures, permits the grain to be heated quickly at the uppermost portion of the front and rear chambers so that it will begin drying quickly once it enters these chambers. As the grain passes downwardly through the compartments, the temperature is lowered slightly adjacent the middle of the compartent. However, when the grain reaches the lower end of the compartment it must be cooled in order to make it the proper temperature for storing. The hot grain could not be stored and it must be cooled prior to storage. Thus, fan 42 functions as a cooling fan for cooling the grain adjacent the lower end of the grain dryer.

Another advantage obtained with the present invention derives from the fact that the first group of ventilator members 36 include some ventilator members which abut against the end walls 18, 20 of the grain dryer. In prior devices, the grain adjacent the end walls did not dry properly, since there was not proper ventilation adjacent these walls. By abutting the ventilator members 36 against the end walls 18, 20 it is possible to obtain circulation of hot air adjacent the end walls, and thereby dry all of the grain that passes down through the grain dryer, including the grain which passes down adjacent the end walls 18, 20.

Another advantage which is obtained by the present invention is the use of a covered feed auger. The adjustable flaps permit good control of the level at which the grain dryer fills and the sensing switch 96 permits grain to be fed into the grain dryer continuously with the switch automatically monitoring when the grain dryer is full and when it is ready for more grain.

The burners used with fans 44, 46 also constitute an improvement over the burners used in prior devices. They utilize alcohol, and because of the circular jets 64, they provide more thorough heating of the air with a minimum use of fuel. The use of the present invention permits the grain to be dried down to the desired moisture content which is usually approximately 12½%.

Another advantage of the present invention is that none of the motors for the various fans need have larger power rating than ten horsepower.

Thus, it can be seen that the device accomplishes at least all of its stated objectives.

What is claimed is:

1. A grain dryer comprising:

an outer housing having two opposite end walls, a front wall, and a rear wall;

a pair of spaced apart upstanding partitions within said housing and dividing said housing into a front compartment, a rear compartment, and one non-partioned central compartment, each of said partitions having a plurality of ventilator openings therein forming communication from said central compartment through said partitions into said front and rear compartments;

each of said front and rear walls having a plurality of exhaust ventilator openings forming communcation from said front and rear compartments to the exterior of said housing;

a first group of elongated ventilator members and a second group of elongated ventilator members within each of said front and rear compartments; each of said ventilator members being elongated and having in cross section an upper wall and an open lower wall, said ventilator members of said first group having one of their ends attached to one of said ventilator openings so as to permit air communication from said central compartment to the area below said upper wall of said ventilator member, said ventilator member of said second group each having one end thereof connected to one of said exhaust openings so as to permit air to communicate from beneath the upper wall to the exterior of said housing;

feed means above said front and rear compartments for depositing grain in the upper ends thereof;

conveyor means below said front and rear compartments for carrying grain away from the lower ends thereof;

a cooling fan positioned in communication with the lower end of said central compartment for forcing ambient air into said central compartment, thence into said first group of ventilator members, thence into said second group of ventilator members and thence outwardly through said exhuast vents to the atmosphere;

at least two heating fans positioned in vertical alignment above said cooling fan for forcing air under pressure into said central compartment, said heating fans having burner means associated therewith for heating the air from said fan prior to the time said air is forced into said central compartment, the burner means of the uppermost of said heating fans being adapted to heat the air exiting therefrom to a temperature substantially greater than the temperature of the air exiting from said lowermost fan;

said cooling fan being free from association with heating means whereby the air forced by said cooling fan into said central compartment is of ambient temperature.

2. A grain dryer according to claim 1 wherein said burner means is adapted to heat the air exiting from said uppermost heater fan to a temperature of approximately 240° F.

3. A grain dryer according to claim 1 comprising a least two of said heater fans positioned in vertical alignment, the uppermost of said heater fans having burner means adapted to heat the air exiting therefrom to a temperature of approximately 240° F. and the lowermost of said heater fans having burner means adapted to heat the air exiting therefrom to a temperature of approximately 200° F.

4. A grain dryer according to claim 1 wherein said feed means comprises an elongated auger positioned above said front and rear compartments, and extending between the two opposite end walls of said housing, an elongated auger channel positioned in covering relation over said auger and comprising in cross section a channel top wall above said auger and a pair of spaced apart channel side walls embracing the opposite side walls of said auger, hopper means mounted adjacent one end of said channel for introducing grain to be dried to one end of said auger, and a cover wall below said auger and being positioned in covering relation over said central compartment.

5. A grain dryer according to claim 4 wherein a pair of vertically disposed extension plates are positioned adjacent the lowermost edges of said channel side walls, adjustable securing means attaching said extension plates to said side channel walls for permitting selective adjustment of the vertical positions of said extension plates with respect to said auger.

6. A grain dryer according to claim 5 wherein said securing means comprises vertical slots in said extension plates and bolt means extending through said slots into threaded engagement with said channel side walls.

7. A grain dryer according to claim 4 wherein a power means is connected to said auger for rotatably driving said auger, control switch means being connected to said power means and having a normal closed position for causing actuation of said power means, said switch means being yieldably movable to an open position deactuating said power means, said switch means being positioned adjacent the end of said auger which is opposite from said hopper means and having a sensing lever responsive to engagement by grain carried by said auger to the proximity of said switch means for causing said switch means to move from said closed to said open position.

8. A grain dryer according to claim 1 wherein at least some of said ventilator members in said first group are in engagement with the interior surfaces of said opposite housing end walls whereby air will be directed from said central compartments through said ventilator members into engagement with said opposite housing end walls.

9. A grain dryer according to claim 1 wherein a conveyor drive means is connected to said conveyor means, said conveyor drive means including a variable speed control for permitting said conveyor to be driven at selectively variable speeds.

10. A grain dryer comprising:

an outer housing having two opposite end walls, a front wall, and a rear wall;

a pair of spaced apart upstanding partitions within said housing and dividing said housing into a front compartment, a rear compartment, and a non-partitioned central compartment, each of said partitions having a plurality of ventilator openings therein forming communication from said central compartment through said partitions into said front and rear compartments;

each of said front and rear walls having a plurality of exhaust ventilator openings forming communication from said front and rear compartments to the exterior of said housing;

a first group of elongated ventilator members and a second group of elongated ventilator members within each of said front and rear compartments; each of said ventilator members being elongated and having in cross section an upper wall and an open lower wall, said ventilator members of said first group having one of their ends attached to one of said ventilator openings so as to permit air communication from said central compartment to the area below said upper wall of said ventilator members, said ventilator members of said second group each having one end thereof connected to one of said exhaust openings so as to permit air to communicate from beneath the upper wall to the exterior of said housing;

feed means above said front and rear compartments for depositing grain in the upper ends thereof;

conveyor means below said front and rear compartments for carrying grain away from the lower ends thereof;

a cooling fan positioned in communication with the lower end of said central compartment for forcing ambient air into said central compartment, thence into said first group of ventilator members, thence into said second group of ventilator members and thence outwardly through said exhaust vents to the atmosphere;

at least one heating fan positioned above said cooling fan for forcing air under pressure into said central compartment, said heating fan having burner means associated therewith for heating the air from said fan prior to the time said air is forced into said central compartment;

said cooling fan being free from association with heating means whereby the air forced by said cooling fan into said central compartment is of ambient temperature;

said feed means comprising an elongated auger positioned above said front and rear compartments, and extending between the two opposite end walls of said housing, an elongated auger channel positioned in covering relation over said auger and comprising in cross section a channel top wall above said auger and a pair of spaced apart channel side walls embracing the opposite sides of said top wall, hopper means mounted adjacent one end of said channel for introducing grain to be dried to one end of said auger, a cover wall below said auger and being positioned in covering relation over said central compartment; and a pair of vertically disposed extension plates positioned adjacent the lowermost edges of said channel side walls, adjustable securing means attaching said extension plates to said side channel walls for permitting selective adjustment of the vertical positions of said extension plates with respect to said auger for controlling the feeding of grain into said dryer.

11. A grain dryer comprising:

an outer housing having two opposite end walls, a front wall, and a rear wall;

a pair of spaced apart upstanding partitions within said housing and dividing said housing into a front compartment, a rear compartment, and a non-partitioned central compartment, each of said partitions having a plurality of ventilator openings therein forming communication from said central compartment through said partitions into said front and rear compartments;

each of said front and rear walls having a plurality of exhaust ventilator openings forming communication from said front and rear compartments to the exterior of said housing;

a first group of elongated ventilator members and a second group of elongated ventilator members within each of said front and rear compartments; each of said ventilator members being elongated and having in cross section an upper wall and an open lower wall, said ventilator members of said first group having one of their ends attached to one of said ventilator openings so as to permit air communication from said central compartment to the area below said upper wall of said ventilator member, said ventilator members of said second group each having one end thereof connected to one of said exhaust openings so as to permit air to communicate from beneath the upper wall to the exterior of said housing;

feed means above said front and rear compartments for depositing grain in the upper ends thereof;

conveyor means below said front and rear compartments for carrying grain away from the lower ends thereof;

a cooling fan positioned in communication with the lower end of said central compartment for forcing ambient air into said central compartment, thence into said first group of ventilator members, thence into said second group of ventilator members and thence outwardly through said exhaust vents to the atmosphere;

at least one heating fan positioned above said cooling fan for forcing air under pressure into said central compartment, said heating fan having burner means associated therewith for heating the air from said fan prior to the time said air is forced into said central compartment;

said cooling fan being free from association with heating means whereby the air forced by said cooling fan into said central compartment is of ambient temperature;

said feed means comprising an elongated auger positioned above said front and rear compartments, and extending between the two opposite end walls of said housing, an elongated auger channel positioned in covering relation over said auger and comprising in cross section a channel top wall above said auger and a pair of spaced apart channel side walls embracing the opposite sides of said top wall, hopper means mounted adjacent one end of said channel for introducing grain to be dried to one end of said auger, a cover wall below said auger and being positioned in covering relation over said central compartment;

a power means connected to said auger for rotatably driving said auger, control switch means being connected to said power means and having a normal closed position for causing actuation of said power means, said switch means being yieldably movable to an open position deactuating said power means, said switch means being positioned adjacent the end of said auger which is opposite from said hopper means and having a sensing lever responsive to engagement by grain carried by said auger to the proximity of said switch means for causing said switch means to move from said closed to said open position;

at least some of said ventilator members in said first group being in engagement with the interior surfaces of said opposite housing end walls whereby air will be directed from said central compartments through said ventilator members into engagement with said opposite housing end walls; and a conveyor drive means is connected to said conveyor means, said conveyor drive means including a variable speed control for permitting said conveyor to be driven at selectively variable speeds.

* * * * *